US006968726B2

(12) United States Patent
Wang

(10) Patent No.: US 6,968,726 B2
(45) Date of Patent: Nov. 29, 2005

(54) PRESS-CONNECTING PLIERS FOR PINS ON ELECTRIC COMMUNICATION TERMINALS

(75) Inventor: Chih-Lang Wang, Taipei Hsien (TW)

(73) Assignee: Hanlong Industrial Co., Ltd., Taipei Hsien (TW)

( * ) Notice: Subject to any disclaimer, the term of this patent is extended or adjusted under 35 U.S.C. 154(b) by 118 days.

(21) Appl. No.: 10/689,640

(22) Filed: Oct. 22, 2003

(65) Prior Publication Data

US 2005/0086993 A1 Apr. 28, 2005

(51) Int. Cl.[7] ..... H01R 43/042; H01R 43/05

(52) U.S. Cl. ..... 72/409.14; 72/409.16; 29/566.4; 29/751

(58) Field of Search ..... 72/409.16, 409.14, 72/409.01, 416, 413; 29/566.4, 751, 566.1

(56) References Cited

U.S. PATENT DOCUMENTS 3,571,888 A * 3/1971 Di Filippo ..... 29/751
4,862,580 A * 9/1989 Wang et al. ..... 29/566.4
5,109,591 A * 5/1992 Hung ..... 29/566.4
5,214,842 A * 6/1993 Chen ..... 29/749
5,992,002 A * 11/1999 Hung ..... 29/566.4
6,629,443 B2 * 10/2003 Chin ..... 72/409.12

* cited by examiner

*Primary Examiner*—Daniel C. Crane
(74) *Attorney, Agent, or Firm*—Bacon & Thomas PLLC

(57) ABSTRACT

The pair of press-connecting pliers for pins on electric communication terminals are provided on the front and rear sides of thereof with three kinds of press-connecting grooves. One of the two sides is formed thereon a first press-connecting groove and a second press-connecting groove, while the other side is formed thereon a third press-connecting groove in opposition to the second press-connecting groove; so that the left and right sides of the press-connecting pliers are formed thereon two terminal holding seats respectively from the first press-connecting groove, the second press-connecting groove and the third press-connecting groove, thereby the two terminal holding seats at least can simultaneously do press connecting for pins on electric communication wires and electric communication terminals of three different types, this simplifies the size of the entire press-connecting pliers.

9 Claims, 8 Drawing Sheets

C-C

D-D

PRESS-CONNECTING PLIERS FOR PINS ON ELECTRIC COMMUNICATION TERMINALS

BACKGROUND OF THE INVENTION

1. Field of the Invention

The present invention is related to a pair of press-connecting pliers for pins on electric communication terminals, and especially to a pair of pin press-connecting pliers provided for press connecting of at least those electric communication wires of three kinds of different sizes with an electric communication terminal, this can reduce the apparent size of the entire press-connecting pliers.

2. Description of the Prior Art

Communication terminals of general telephone communication wires have different styles in pursuance of various usages and the electric communication wires used, and also in pursuance of the English specification or the American specification of electric communication terminal; classes and specifications of them are quite various.

By the fact that pins of the abovementioned electric communication terminals of various classes and specifications are quite thin and small, they needs to be press connected by using press-connecting grooves and press-connecting die-blocks of different sizes provided on a pair pliers in order that electric communication wires can be fixed on the electric communication terminals; conventional press-connecting pliers for pins on electric communication terminals are divided into a single-hole type, a dual-hole type and a triple-hole type in pursuance of the numbers of the pins on the terminals. The single-hole type press-connecting pliers can only do press connecting on a single electric communication terminal; the dual-hole type press-connecting pliers can do press connecting on an electric communication terminal with two different specifications, while the triple-hole type press-connecting pliers can do press connecting on an electric communication terminal with different specifications, such as is shown in FIG. 1.

The above stated single-hole type press-connecting pliers can only do press connecting on a single electric communication terminal, pairs of press-connecting pliers of different specifications must be carried when in use, this makes a user inconvenient; the dual-hole type press-connecting pliers need only that a user carries another pair of single-hole type press-connecting pliers, it can render the amount carried reduced, but this is not the most convenient way for carrying; hence development of the triple-hole type press-connecting pliers surely brings a quite convenient effect to users. However, referring to FIG. 1, press-connecting grooves 60 of such triple-hole type press-connecting pliers are formed by providing three holes on the same one of the shanks of the pliers, this results a larger working area on the press-connecting pliers and a quite heavy whole appearance, and occupies a larger space when in carrying.

And more, every pair of press-connecting pliers are provided with a peeling knife 42 to cut and peel insulation layers enveloping electric communication wires, a peeling knife 42 provided on a pair of conventional press-connecting pliers has two knife blades arranged in mutual opposite positions to be benefit to cutting and peeling for a user. By virtue that the cross sectional areas of wires are slightly different, some press-connecting pliers are formed with grooves with different diameters on one end of the peeling knife 42, so that the peeling knife 42 can cut and peel on electric communication wires with different diameters. This mode can allow cutting and peeling on electric communication wires with different diameters, but one end of the pair of press-connecting pliers shall be formed with grooves of different diameters; thus not only the proper strength of the peeling knife 42 is destroyed, but also the appearance of the pliers is bad.

And further, in the above stated press-connecting pliers, two handles 40 can restore their proper positions after they are held and pressed by the elastic restoration force of a torsional spring "A", and by then, the action of press connecting of pins is completed. However, when the two handles 40 restore their proper positions after they are held and pressed by means of the torsional spring "A", they are subjected to bearing uniform forces, this makes press-connecting grooves on two or three sides bear ununiform forces, and pins on electric communication terminals on the two or three sides are unable to be uniformly press connected in the electric communication wires, and problem of inferior function of the electric communication terminals is resulted.

SUMMARY OF THE INVENTION

In view of the above problems resided in the above conventional press-connecting pliers for long in use and carrying, the inventor of the present invention developed the pair of press-connecting pliers for pins on electric communication terminals based on his professional experience of years in studying, designing and manufacturing same kind of products and after hard study, developing, as well as repeated experiments and tests, it can solve the problems resided in the conventional press-connecting pliers.

Whereas, the press-connecting pliers for pins on electric communication terminals of the present invention are provided on the front and rear sides of the tool itself with three kinds of press-connecting grooves. One of the two sides is formed thereon a first press-connecting groove and a second press-connecting groove, while the other side is formed thereon a third press-connecting groove in opposition to the second press-connecting groove; so that the left and right sides of the press-connecting pliers are formed thereon two terminal holding seats respectively from the first press-connecting groove, the second press-connecting groove and the third press-connecting groove, thereby the two terminal holding seats at least can simultaneously do press connecting for pins on electric communication wires and electric communication terminals of three different types, this can simplify the apparent size of the entire press-connecting pliers.

The object of the present invention is resided in: by forming on the front and rear sides of the press-connecting pliers the two terminal holding seats from the first press-connecting groove, the second press-connecting groove and the third press-connecting groove, the pliers at least can do press connecting for pins on electric communication wires and electric communication terminals of three different types, thus it simplifies the apparent size of the entire press-connecting pliers.

Another object of the present invention is resided in: the handles of the press-connecting pliers are provided on the upper ends thereof with waving pieces in opposition to two pusher elements and two elastic elements provided on a main plate for pushing the waving pieces, so that when the handles are held and pressed, the pusher elements and elastic elements can create restoring forces against the handles and keep the latter in the opened state.

Another object of the present invention is resided in: the press-connecting pliers are provided on one side thereof with a wire peeling-knife, a push block is provided on one side of the peeling knife; the push block is provided thereon with a groove facing to the peeling knife, and is provided on the rear end thereof with a spring for pushing the push block; so that the peeling knife can do cutting and peeling on electric communication wires with different diameters by means of the push block and the spring.

The present invention will be apparent in its content and its effect to be achieved after reading the detailed description of the preferred embodiment thereof in reference to the accompanying drawings.

DETAILED DESCRIPTION OF THE PREFERRED EMBODIMENT

Figure 1:
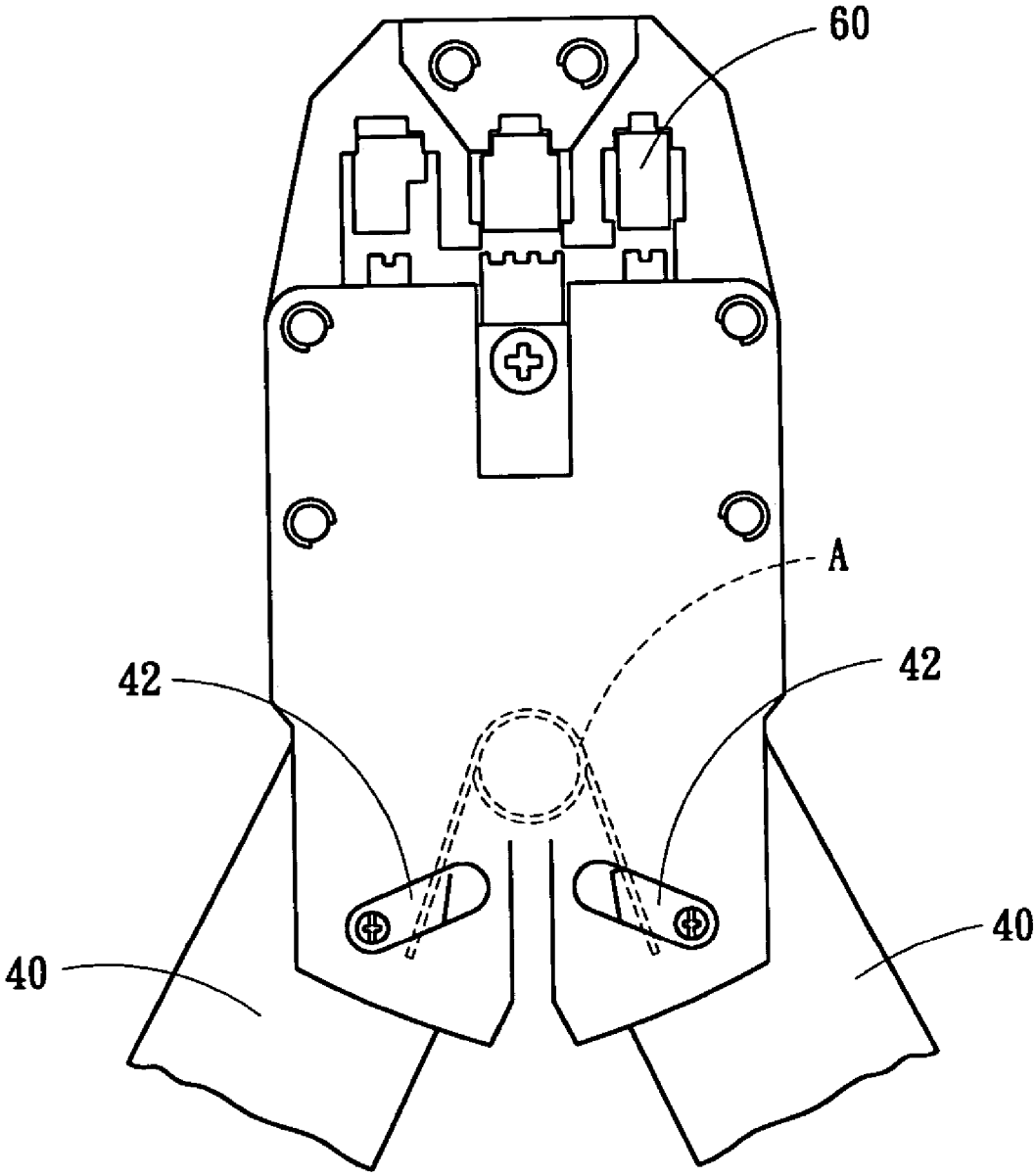
FIG. 1 (PRIOR ART)
FIG. 1 is a schematic view showing a pair of conventional press-connecting pliers.
Figure 2:
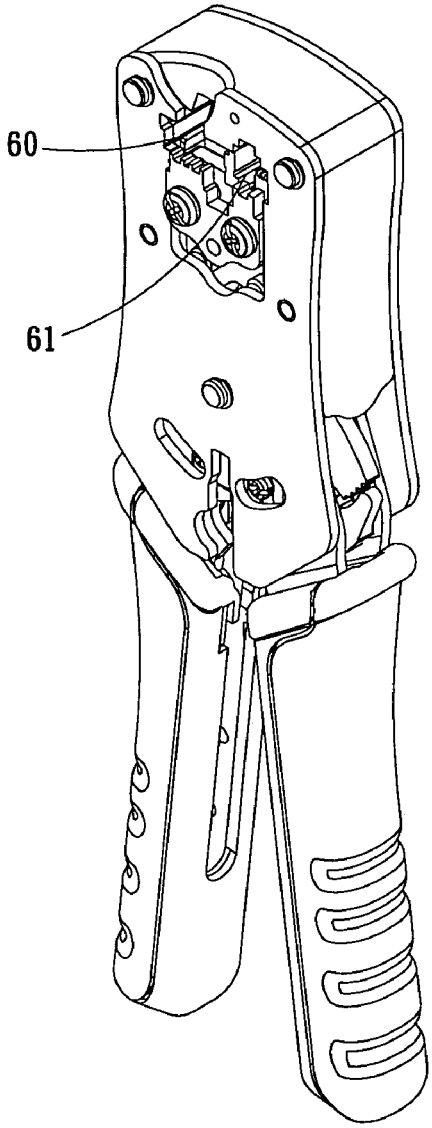
FIG. 2 is a schematic perspective view showing the front side of the press-connecting pliers of the present invention.
Figure 3:
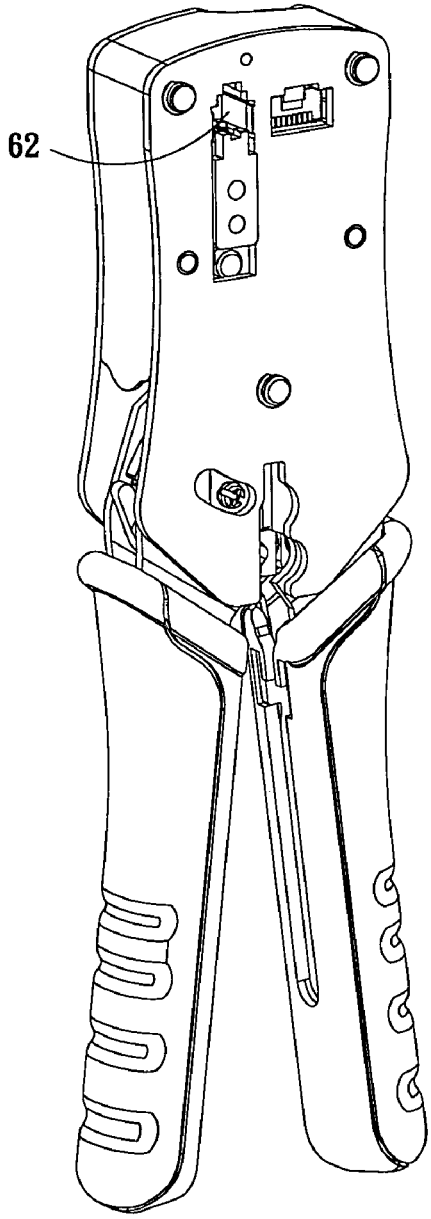
FIG. 3 is a schematic perspective view showing the rear side of the press-connecting pliers of the present invention.

As shown in FIGS. 2 and 3, the press-connecting pliers for pins on electric communication terminals of the present invention mainly are provided on the front and rear sides thereof with three kinds of press-connecting grooves with different specifications. One of the two sides is formed thereon a first press-connecting groove 60 and a second press-connecting groove 61, while the other side is formed thereon a third press-connecting groove 62 in opposition to the second press-connecting groove 61; so that the left and right sides of the press-connecting pliers are formed thereon two terminal holding seats from the first press-connecting groove 60, the second press-connecting groove 61 respectively and the third press-connecting groove 62, thereby the press-connecting pliers at least can do press connecting for pins on electric communication wires and electric communication terminals of three different types with the two terminal holding seats.

Figure 4:
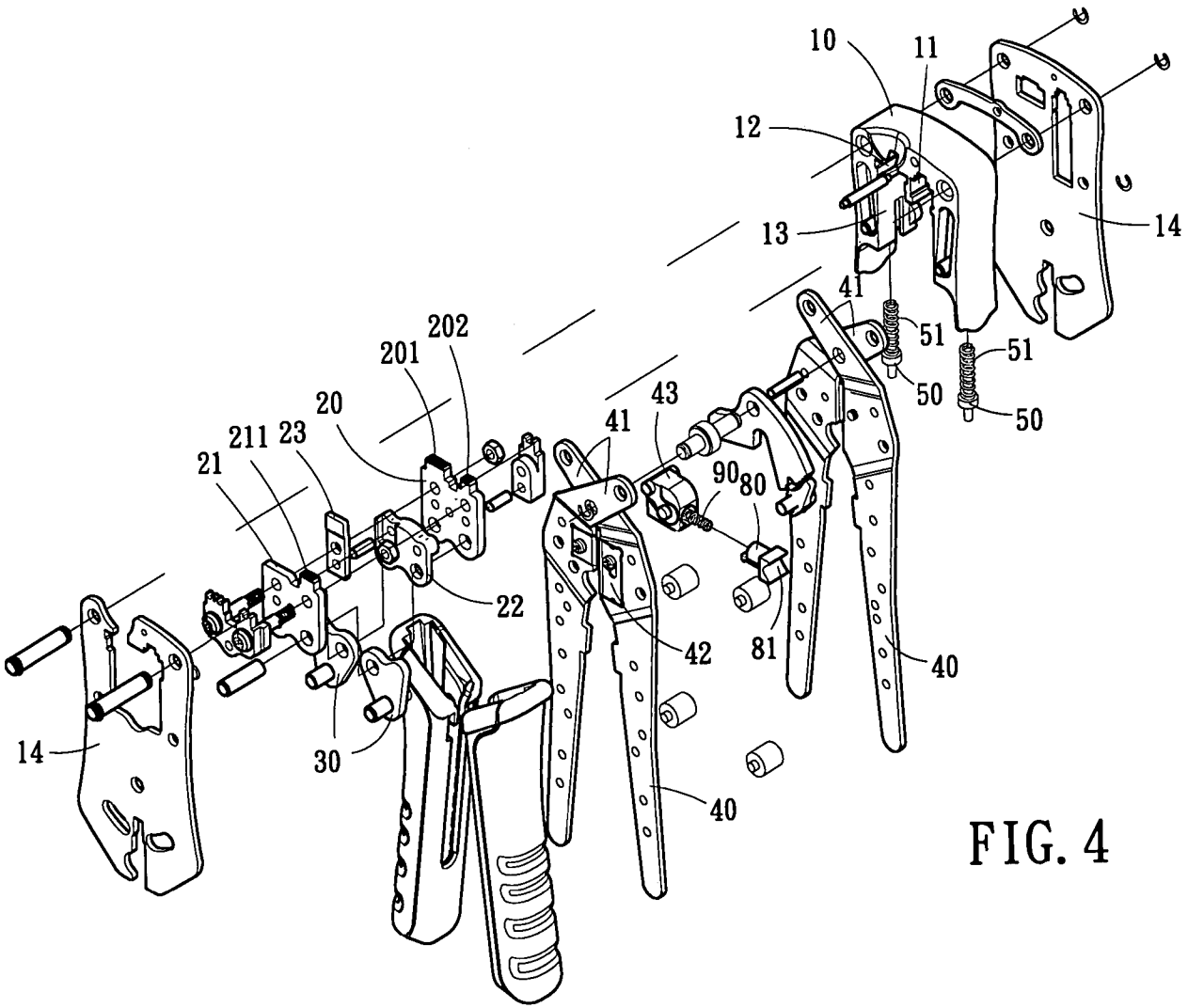
FIG. 4 is an analytical perspective view of the press-connecting pliers of the present invention.
Figure 5:
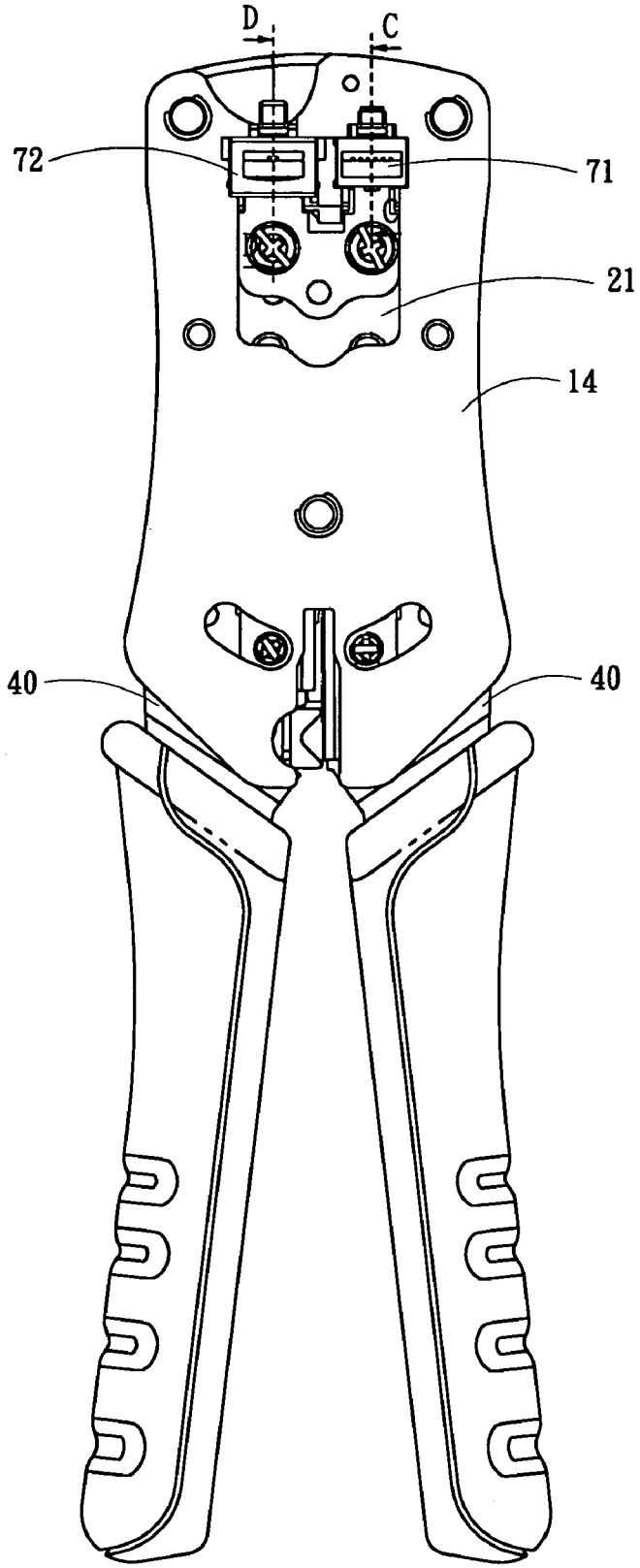
FIG. 5 is a schematic front view showing the appearance of the present invention.

As to the entire structure of the present invention, referring to FIGS. 4 and 5, a main plate 10 is used as a main body, the main plate 10 is provided thereon with a first terminal holding seat 11 and a second terminal holding seat 12. The main plate 10 is provided with a slide slot 13 arranged parallel to the direction of insertion of fixing pins on the electric communication wires and extending to the area where the first terminal holding seat 11 and the second terminal holding seat 12 are. The slide slot 13 is slipped therein for being connected therewith of a first press-connecting sheet 20 and a second press-connecting sheet 21; the first press-connecting sheet 20 is formed thereon a first press-connecting die-block 201 and a second press-connecting die-block 202, the second press-connecting sheet 21 is formed thereon a third press-connecting die-block 211 in opposition to the second press-connecting die-block 202, so that they can form with the first terminal holding seat 11 and the second terminal holding seat 12 of the main plate 10 the first press-connecting groove 60, the second press-connecting groove 61 and the third press-connecting groove 62 of three different specifications (referring also to FIGS. 2 and 3). The first press-connecting sheet 20 and the second press-connecting sheet 21 are provided therebetween with a spacing piece 22, the spacing piece 22 and the second press-connecting sheet 21 have therebetween a stop piece 23 in opposition by position to the first press-connecting die-block 201, a fixing plate 14 is provided exteriorly of the first press-connecting sheet 20 and the second press-connecting sheet 21.

The first press-connecting sheet 20 and the second press-connecting sheet 21 are connected on the lower ends thereof with waving pieces 30 of which the lower ends are connected with two pusher plates 41 provided on the upper ends of two handles 40; two pairs of pusher elements 50 and elastic elements 51 are provided at the lateral sides respectively of the waving pieces 30 and in the main plate 10, so that a user can move the first press-connecting sheet 20, the second press-connecting sheet 21 and the pusher elements 50 toward the interior of the main plate 10 by means of the waving pieces 30 when the handles 40 are held and pressed. This is benefit to press connecting the electric communication wires having fixed pins with the electric communication terminals by the first press-connecting die-block 201, the second press-connecting die-block 202 and the third press-connecting die-block 211 formed by the first press-connecting sheet 20 and the second press-connecting sheet 21, and thereby press connecting of the pins on the electric communication terminals with the electric communication wires can be completed.

Thereby, the first press-connecting sheet 20, the second press-connecting sheet 21, the spacing piece 22 and the waving pieces 30 are connected with one another, and are connected with the pusher plates 41 provided on the upper ends of two handles 40; so that when the handles 40 are held and pressed, the pusher plates 41 provided on the upper ends of two handles 40 move the waving pieces 30 which in turn move the first press-connecting sheet 20, the second press-connecting sheet 21 and the spacing piece 22, and thereby the first press-connecting sheet 20 and the second press-connecting sheet 21 are moved upwardly along the slide slot 13 formed on the main plate 10. By virtue that the first press-connecting sheet 20 and the second press-connecting sheet 21 are pushed upwardly by means of two mutual opposite waving pieces 30, they can be assured to be pushed synchronically upwardly along the slide slot 13 by even forces to result uniform press connecting; this makes the press-connecting pliers able to do press connecting on electric communication terminals of at least three different types with three press-connecting grooves of different specifications.

Figure 6:
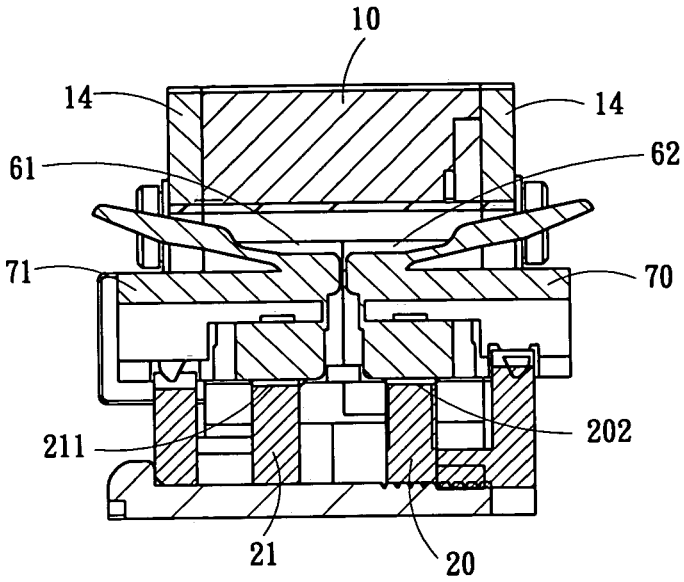
FIG. 6 is a schematic sectional view taken from a sectional line in C—C FIG. 5.
Figure 7:
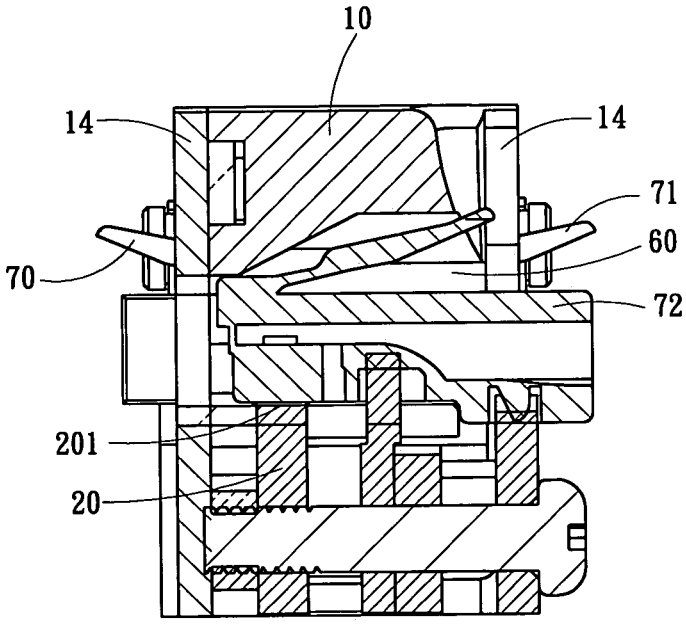
FIG. 7 is a schematic sectional view taken from a sectional line D—D in FIG. 5.

Referring to FIGS. 5–7 which are schematic views showing insertion of electric communication terminals into the terminal holding seats, as are depicted, the second press-connecting groove 61 and the third press-connecting groove 62 formed from the second press-connecting die-block 202, the third press-connecting die-block 211 and the main plate 10 are opposite to each other, so that the second press-connecting groove 61 and the third press-connecting groove 62 can be respectively received therein electric communication terminals 70, 71 of different types. While the first press-connecting groove 60 formed from the first press-connecting die-block 201 and the main plate 10 can receive another type of electric communication terminal 72. Thereby when the first press-connecting sheet 20 and the second press-connecting sheet 21 are moved upwardly, the two terminal holding seats communicating with each other formed from the first press-connecting groove 60, the second press-connecting groove 61 and the third press-connecting groove 62 on the front and rear sides of the press-connecting pliers can be used to do press connecting simultaneously on the electric communication terminals 70, 71, 72 of at least three different types.

Additionally, in practicing the present invention, the area where the first press-connecting die-block 201 of the first press-connecting sheet 20 in opposition to the second press-connecting sheet 21 is located can also be provided with a fourth press-connecting die-block (not shown), in this way, the first press-connecting sheet 20 and the second press-connecting sheet 21 also form two terminal holding seats; and the two terminal holding seats at least can do press connecting on electric communication terminals with four different types, and practicability of the press-connecting pliers can be increased.

Figure 8:
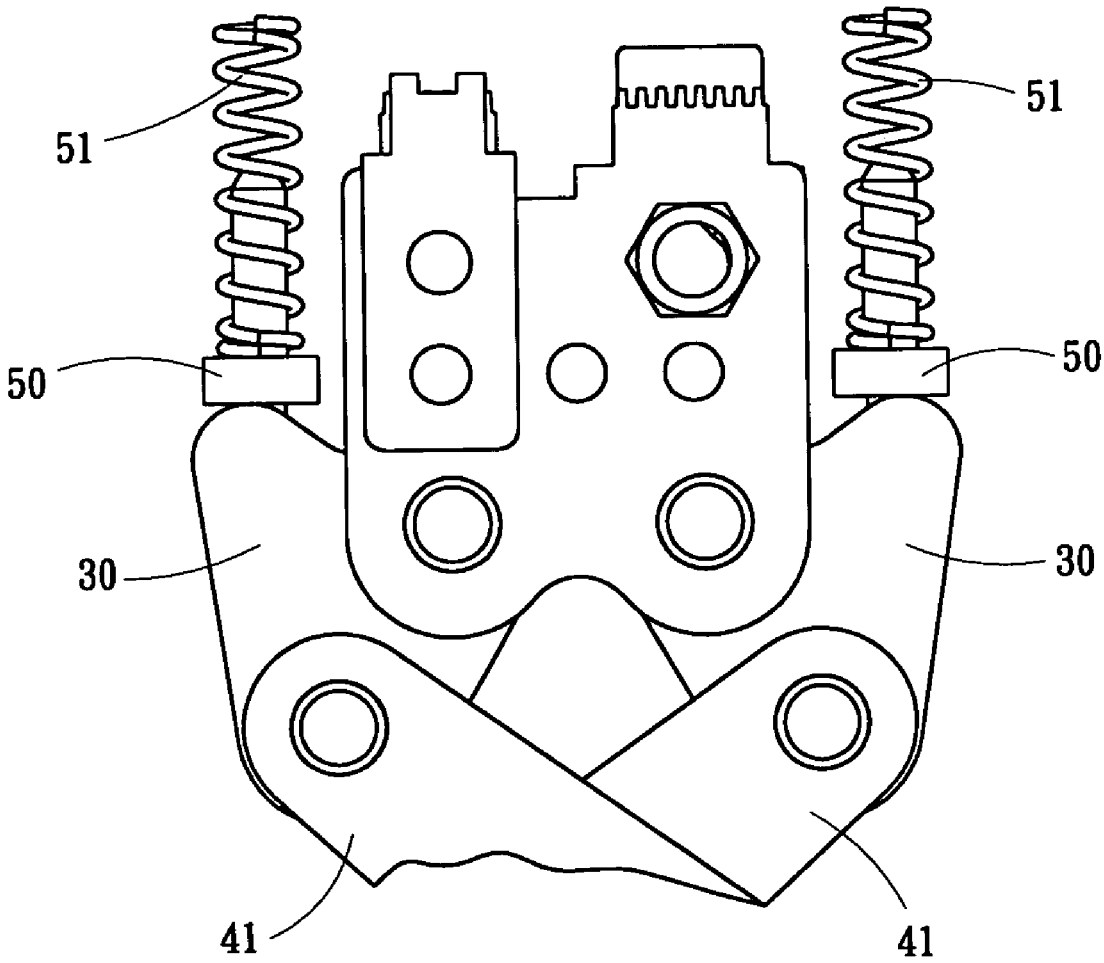
FIG. 8 is a schematic view showing position restoration of a pair of handles.

Referring to FIGS. 4 and 8, the waving pieces 30 are provided thereon with the pusher elements 50, and the pusher elements 50 are provided thereon with the elastic elements 51, while the pusher elements 50 and the elastic elements 51 are received in the main plate 10; so that the elastic elements 51 are abutted against the inner wall of the main plate 10. Hence the handles 40 bring the waving pieces 30 to wave when the handles 40 are held and pressed to move the pusher elements 50 upwardly to compress the elastic elements 51. At this time, the elastic elements 51 store energy therein; so that the pusher elements 50 are acted by the hidden elastic restoring forces of the elastic elements 51 to push the waving pieces 30, and in turn move the handles 40 to make them restore to their original positions, thus the action of press connecting is completed.

Figure 9:
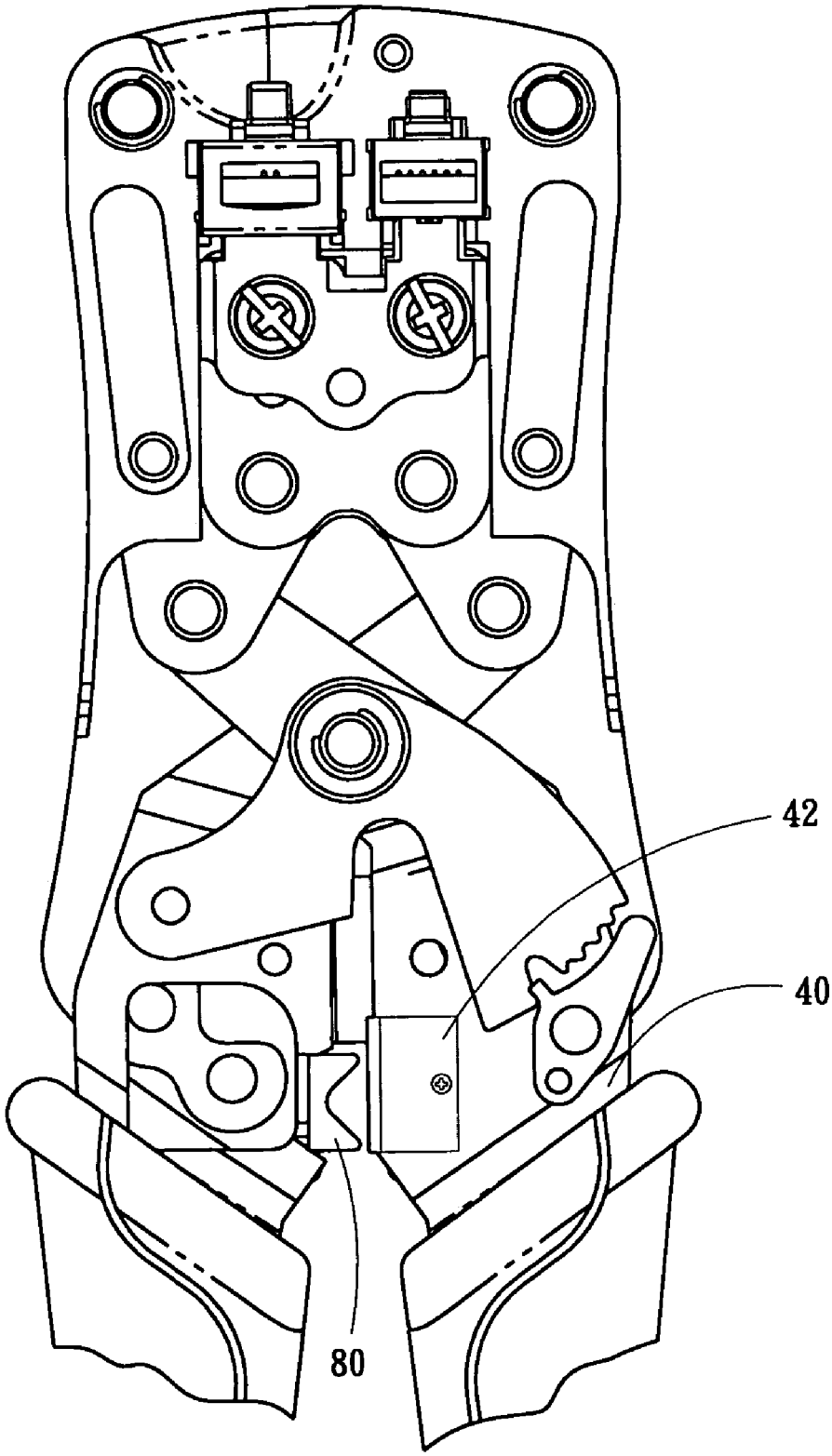
FIG. 9 is a schematic view showing a wire peeling-knife of the present invention.
Figure 10:
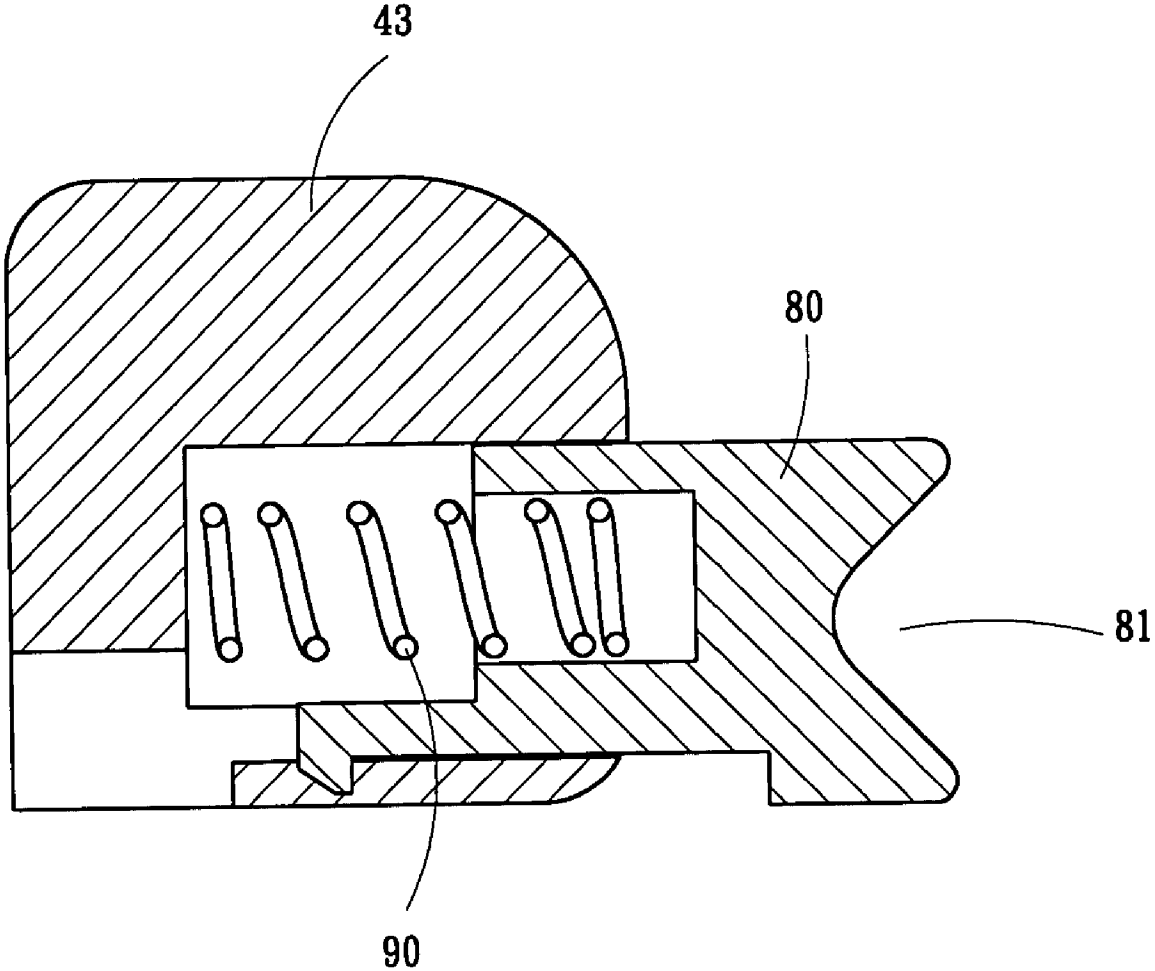
FIG. 10 is a schematic sectional view showing a push block and a fixing element of the present invention.

Referring to FIGS. 4, 9 and 10, one side of the handles 40 is provided with a wire peeling-knife 42, a push block 80 is provided on one side of the peeling knife 42; the push block 80 is provided thereon with a groove 81 facing to the peeling knife 42, and is provided on the rear end thereof with a spring 90 abutting on a fixing element 43 provided between the two handles 40, in order that the push block 80 can displace axially in the fixing element 43 by the action of the spring 90. When the electric communication wires are placed between the push block 80 and the peeling knife 42, they are pushed toward the peeling knife 42 by the elastic restoring forces of the spring 90, hence the peeling knife 42 can cut and peel the electric communication wires in a way of circling about; this can render the handles 40 to do the operation of cutting and peeling on electric communication wires of different diameters.

The names of the members composing the present invention and shown in the drawings are only for illustrating the present invention and not for giving any limitation to the scope of the present invention. It will be apparent to those skilled in this art that various equivalent modifications or changes without departing from the spirit of this invention shall also fall within the scope of the appended claims.

What is claimed is:

1. A pair of press-connecting pliers for pins on electric communication terminals, comprising:

a main body having a front side and a rear side, said main body having provided on one of said sides a first press-connecting groove and a second press-connecting groove, said main body having provided on the other of said sides a third press-connecting groove in opposition to said second press-connecting groove, each of the first, second, and third press-connecting grooves conforming to a different press-connecting specification, whereby said press-connecting pliers is provided with three press-connecting grooves of different specification;

a first terminal holding seat formed in said main body in alignment with said first press-connecting groove;

a second terminal holding seat formed in said main body in alignment with said second press-connecting groove;

wherein said main body comprises a main plate provided thereon with two handles, the main plate containing therein a first press-connecting sheet and a second press-connecting sheet, the first press-connecting sheet having formed thereon a first press-connecting die-block and a second press-connecting die-block, the second press-connecting sheet having formed thereon a third press-connecting die-block in opposition to said second press-connecting die-block, the first press-connecting sheet forming, together with said main plate, said first, second, and third press-connecting grooves; and wherein said handles are provided on the upper ends thereof with waving pieces, said waving pieces are connected with said two press-connecting sheets and provided at two lateral sides respectively of said waving pieces with two pusher elements, said pusher elements are slipped thereover with two elastic elements, said pusher elements and said elastic elements provided in said main plate; so that when said handles are held and pressed, said press-connecting sheets are pushed uniformly upwardly, and when said handles are released, said handles restore their proper positions by restoring forces of said elastic elements.

2. The pair of press-connecting pliers for pins on electric communication terminals as defined in claim 1, wherein said press-connecting sheets are provided therebetween with a spacing piece, said spacing piece provided with a stop piece in alignment by position with said first press-connecting groove.

3. The pair of press-connecting pliers for pins on electric communication terminals as defined in claim 1, wherein one side of said handles is provided with a wire peeling-knife, a push block is provided on one side of said peeling knife; said push block is provided thereon with a groove facing to said peeling knife, and is provided on a rear end thereof with a spring abutting on a fixing element provided between said two handles, in order that said push block displaces axially in said fixing element by action of said spring; said peeling knife is adapted for cutting and peeling electric communication wires.

4. A pair of press-connecting pliers for pins on electric communication terminals, comprising:

a main body having a front side and a rear side, said main body having provided on one of said sides a first press-connecting groove and a second press-connecting groove, said main body having provided on the other of said sides a third press-connecting groove in opposition to said second press-connecting groove, each of the first, second, and third press-connecting grooves conforming to a different press-connecting specification, whereby said press-connecting pliers is provided with three press-connecting grooves of different specification;

a first terminal holding seat formed in said main body in alignment with said first press-connecting groove;

a second terminal holding seat formed in said main body in alignment with said second press-connecting groove;

wherein said main body comprises a main plate provided thereon with two handles, the main plate containing therein a first press-connecting sheet and a second press-connecting sheet, the first press-connecting sheet having formed thereon a first press-connecting die-block and a second press-connecting die-block, the second press-connecting sheet having formed thereon a third press-connecting die-block in opposition to said second press-connecting die-block, the first press-connecting sheet forming, together with said main plate, said first, second, and third press-connecting grooves;

wherein said press-connecting sheets are provided therebetween with a spacing piece, said spacing piece being provided with a stop piece in alignment by position with said first press-connecting groove.

5. The pair of press-connecting pliers for pins on electric communication terminals as defined in claim 4, wherein said handles are provided on the upper ends thereof with waving pieces, said waving pieces are connected with said two press-connecting sheets and is provided at two lateral sides respectively of said waving pieces with two pusher elements, said pusher elements are slipped thereover with two elastic elements, said pusher elements and said elastic elements being provided in said main plate; so that when said handles are held and pressed, said press-connecting sheets are pushed uniformly upwardly, and when said handles are released, said handles restore their proper positions by restoring forces of said elastic elements.

6. The pair of press-connecting pliers for pins on electric communication terminals as defined in claim 4, wherein one side of said handles is provided with a wire peeling-knife, a push block is provided on one side of said peeling knife; said push block is provided thereon with a groove facing to said peeling knife, and is provided on a rear end thereof with a spring abutting on a fixing element provided between said two handles, in order that said push block displaces axially in said fixing element by action of said spring; hence said peeling knife is adapted for cutting and peeling electric communication wires.

7. A pair of press-connecting pliers for pins on electric communication terminals, comprising:

a main body having a front side and a rear side, said main body having provided on one of said sides a first press-connecting groove and a second press-connecting groove, said main body having provided on the other of said sides a third press-connecting groove in opposition to said second press-connecting groove, each of the first, second, and third press-connecting grooves conforming to a different press-connecting specification, whereby said press-connecting pliers is provided with three press-connecting grooves of different specification;

a first terminal holding seat formed in said main body in alignment with said first press-connecting groove;

a second terminal holding seat formed in said main body in alignment with said second press-connecting groove;

wherein said main body comprises a main plate provided thereon with two handles, the main plate containing therein a first press-connecting sheet and a second press-connecting sheet, the first press-connecting sheet having formed thereon a first press-connecting die-block and a second press-connecting die-block, the second press-connecting sheet having formed thereon a third press-connecting die-block in opposition to said second press-connecting die-block, the first press-connecting sheet forming, together with said main plate, said first, second, and third press-connecting grooves;

wherein one side of said handles is provided with a wire peeling-knife, a push block is provided on one side of said peeling knife; said push block is provided thereon with a groove facing toward said peeling knife, and is provided on a rear end thereof with a spring abutting on a fixing element provided between said two handles, in order that said push block displaces axially in said fixing element by action of said spring; hence said peeling knife is adapted for cutting and peeling electric communication wires.

8. The pair of press-connecting pliers for pins on electric communication terminals as defined in claim 7, wherein said handles are provided on the upper ends thereof with waving pieces, said waving pieces are connected with said two press-connecting sheets and provided at two lateral sides respectively of said waving pieces with two pusher elements, said pusher elements are slipped thereover with two elastic elements, said pusher elements and said elastic elements provided in said main plate; so that when said handles are held and pressed, said press-connecting sheets are pushed uniformly upwardly, and when said handles are released, said handles restore their proper positions by restoring forces of said elastic elements.

9. The pair of press-connecting pliers for pins on electric communication terminals as defined in claim 7, wherein said press-connecting sheets are provided therebetween with a spacing piece, said spacing piece is provided with a stop piece in alignment by position with said first press-connecting groove.

* * * * *